US011148412B2

(12) United States Patent
Suzuki et al.

(10) Patent No.: US 11,148,412 B2
(45) Date of Patent: Oct. 19, 2021

(54) ROLL-TO-ROLL PRINTING APPARATUS

(71) Applicants: ASAHI KASEI KABUSHIKI KAISHA, Tokyo (JP); SUMITOMO HEAVY INDUSTRIES, LTD., Tokyo (JP)

(72) Inventors: Keita Suzuki, Tokyo (JP); Shinya Matsubara, Tokyo (JP); Taishi Hitomi, Tokyo (JP); Makoto Ikeda, Tokyo (JP); Kiyoto Miyoshi, Yokosuka (JP); Takatora Ando, Yokosuka (JP)

(73) Assignees: ASAHI KASEI KABUSHIKI KAISHA, Tokyo (JP); SUMITOMO HEAVY INDUSTRIES, LTD., Tokyo (JP)

( * ) Notice: Subject to any disclaimer, the term of this patent is extended or adjusted under 35 U.S.C. 154(b) by 134 days.

(21) Appl. No.: 16/349,526

(22) PCT Filed: Nov. 7, 2017

(86) PCT No.: PCT/JP2017/040148
§ 371 (c)(1),
(2) Date: May 13, 2019

(87) PCT Pub. No.: WO2018/088407
PCT Pub. Date: May 17, 2018

(65) Prior Publication Data

US 2019/0344558 A1 Nov. 14, 2019

(30) Foreign Application Priority Data

Nov. 14, 2016 (JP) ..... JP2016-221965

(51) Int. Cl.
*B41F 33/06* (2006.01)
*B41F 13/02* (2006.01)

(52) U.S. Cl.
CPC ..... *B41F 33/06* (2013.01); *B41F 13/02* (2013.01)

(58) Field of Classification Search
CPC ..... B41F 33/06
(Continued)

(56) References Cited

U.S. PATENT DOCUMENTS 4,359,178 A 11/1982 Hayashi et al.
5,937,756 A * 8/1999 Kishine ..... B41F 13/02 101/181

(Continued)

FOREIGN PATENT DOCUMENTS

DE 2328204 A 2/1974
GB 1600058 A 10/1981

(Continued)

OTHER PUBLICATIONS

International Preliminary Report on Patentability and English translation of the Written Opinion of the International Searching Authority for International Application No. PCT/JP2017/040148, dated May 14, 2019.

(Continued)

*Primary Examiner* — Anthony H Nguyen
(74) *Attorney, Agent, or Firm* — Birch, Stewart, Kolasch & Birch, LLP

(57) ABSTRACT

In order to provide, to a roll-to-roll printing apparatus which seamlessly performs printing on a base material using a roll-to-roll method, performance for finely controlling the tension of the base material, the roll-to-roll printing apparatus includes a drive roll (74) that supplies a base material (B) to a plate cylinder, a drive roll actuator that rotates the drive roll (74), a dancer actuator (84) that changes a path line length of the base material (B) to vary the tension of the base material (B), a tension detection device (78) that detects the (Continued)

tension of the base material (B), and a tension control device (80) that controls the drive roll actuator and the dancer actuator (84) in accordance with a result of the detection by the tension detection device (78) to compensate for a variation in the tension of the base material (B). When compensating for the variation in the tension of the base material (B), the tension control device (80) uses the drive roll actuator to perform relatively rough control, while using the dancer actuator (84) to perform relatively fine control.

5 Claims, 2 Drawing Sheets

(58) Field of Classification Search
USPC ..... 101/407.1
See application file for complete search history.

(56) References Cited

U.S. PATENT DOCUMENTS

| | | | | |
|---|---|---|---|---|
| 6,820,549 | B2 * | 11/2004 | Iyokawa | B65H 23/185 101/228 |
| 2004/0074407 | A1 * | 4/2004 | Iyokawa | B65H 45/22 101/228 |
| 2004/0256435 | A1 | 12/2004 | St. Germain | |
| 2005/0034578 | A1 * | 2/2005 | Brandenburg | B65H 23/1882 83/13 |
| 2006/0125899 | A1 * | 6/2006 | Cornish | B41J 3/407 347/104 |
| 2009/0193989 | A1 | 8/2009 | Senoo | |
| 2009/0294038 | A1 * | 12/2009 | Jurkewitz | B65H 37/002 156/234 |
| 2011/0267637 | A1 | 11/2011 | Oza | |
| 2015/0239234 | A1 * | 8/2015 | Regelsberger | B65H 23/1888 101/481 |
| 2017/0282602 | A1 * | 10/2017 | Aoki | B41J 13/0009 |
| 2018/0273330 | A1 * | 9/2018 | Kakimoto | B65H 20/02 |

FOREIGN PATENT DOCUMENTS

| | | | |
|---|---|---|---|
| JP | 4-341450 | A | 11/1992 |
| JP | 6-41648 | A | 2/1994 |
| JP | 2000-117950 | A | 4/2000 |
| JP | 2002-234648 | A | 8/2002 |
| JP | 2002-248743 | A | 9/2002 |
| JP | 2004-262061 | A | 9/2004 |
| JP | 2006-76036 | A | 3/2006 |
| JP | 2006-76037 | A | 3/2006 |
| JP | 2006-256216 | A | 9/2006 |
| JP | 2007-136776 | A | 6/2007 |
| JP | 2008-23751 | A | 2/2008 |
| JP | 2008-55707 | A | 3/2008 |
| JP | 2009-72938 | A | 4/2009 |
| JP | 2010-94947 | A | 4/2010 |
| JP | 2016-132522 | A | 7/2016 |
| KR | 10-0226036 | B1 | 10/1999 |

OTHER PUBLICATIONS

International Search Report, issued in PCT/JP2017/040148, PCT/ISA/210, dated Jan. 9, 2018.

Written Opinion of the International Searching Authority, issued in PCT/JP2017/040148, PCT/ISA/237, dated Jan. 9, 2018.

Extended European Search Report, dated Aug. 16, 2019, for European Application No. 17870495.3.

* cited by examiner

ROLL-TO-ROLL PRINTING APPARATUS

TECHNICAL FIELD

The present invention relates to a roll-to-roll printing apparatus.

BACKGROUND ART

In recent years, techniques which manufacture electronic devices using printing methods have been developed. Among them, a reverse printing method (reverse offset printing) has been studied as a method of printing an electronic device at a high definition of not more than 10 micrometers, and development of printers therefor has been pursued.

As such a reverse printing system, a roll-to-roll printing apparatus has been proposed which seamlessly performs reverse printing on a base material using a roll-to-roll method. Roll-to-roll printing apparatuses each using a roll-to-roll method include a printing apparatus using a compensator roll-less control method which controls tension between two drive rolls that feed a base material by maintaining a rotation speed difference between the two drive rolls and a printing apparatus using a compensator roll method which controls tension between drive rolls rotating at the same speed by placing a dancer actuator between the drive rolls and manipulating a path line length. In either of the methods, the relationship between a tension variation and an overlay printing accuracy is modeled and, using an amount of operation occurring in a previous-stage unit, the influence of the tension variation is suppressed by an amount of operation in a subsequent-stage unit under feed-forward control. Thus, the overlay printing accuracy in the subsequent stage is maintained (see, for example, patent documents 1 to 3).

CITATION LIST

Patent Document

Patent Document 1: JP2008-055707A
Patent Document 2: JP2010-094947A
Patent Document 3: JP2002-248743A

SUMMARY

Technical Problem

However, in the non-compensator control method, an operable actuator is the drive rolls each having large inertia so that there is a limit to performing fine control. On the other hand, in the compensator roll method, there is a limit to the range of operation so that there is a limit to a tension variation that can be suppressed. This results in apparatus design in which a tension variation that may actually occur can be inhibited. Consequently, inertia increases to degrade the accuracy of the actuator, leading to the problem that sufficient overlay printing accuracy is not obtained.

An object of the present invention is to provide a roll-to-roll printing apparatus having performance for finely controlling the tension of a base material.

Solution to Problem

A printing apparatus according to an aspect of the present invention is a roll-to-roll printing apparatus which includes an unwinding unit that unwinds a base material, a printing unit that performs printing on the base material unwound from the unwinding unit, and a winding unit that winds up the base material subjected to the printing by the printing unit, the roll-to-roll printing apparatus seamlessly performing printing on the base material using a roll-to-roll method, the roll-to-roll printing apparatus including: a drive roll that supplies the base material to a printing portion; a drive roll actuator that rotates the drive roll; a dancer actuator disposed between the drive roll and another drive roll to vary a tension of the base material by changing a path line length of the base material; a tension detection device that detects the tension of the base material; and a tension control device that controls the drive roll actuator and the dancer actuator in accordance with a result of the detection by the tension detection device to compensate for a variation in the tension of the base material. When compensating for the variation in the tension of the base material, the tension control device uses the drive roll actuator to perform relatively rough control while using the dancer actuator to perform relatively fine control.

The dancer actuator is configured to have excellent responsibility such as achieving a reduction in physical frictional resistance. Accordingly, by using a dancer actuator having actuator performance which is more responsive and more accurate (move sensitive) than that of a typical dancer, a sensitivity characteristic difference is produced. As a result, it is possible to control the tension of the base material with accuracy higher than that achieved by a prior and existing combination such as a combination of a dancer and an actuator which drives the dancer. Therefore, while it is conventional common practice to perform tension control by rotating drive rolls using an actuator and compensate for a tension variation, the roll-to-roll printing apparatus according to the present aspect uses the dancer actuator to more finely control the tension and thus allows for accurate compensation of a tension variation.

The dancer actuator may be disposed between the two consecutive drive rolls.

The tension control device may use the dancer actuator to perform feedback control on the drive roll actuator for the drive roll disposed in a stage previous to the dancer actuator and perform feed-forward control on the drive roll actuator for the drive roll disposed in a stage subsequent to the dancer actuator.

Advantageous Effects of Invention

According to the present invention, it is possible to provide a roll-to-roll printing apparatus having performance for finely controlling the tension of a base material.

DESCRIPTION OF EMBODIMENTS

Referring to the accompanying drawings, a description will be given of a preferred embodiment of the present invention.

Figure 1:
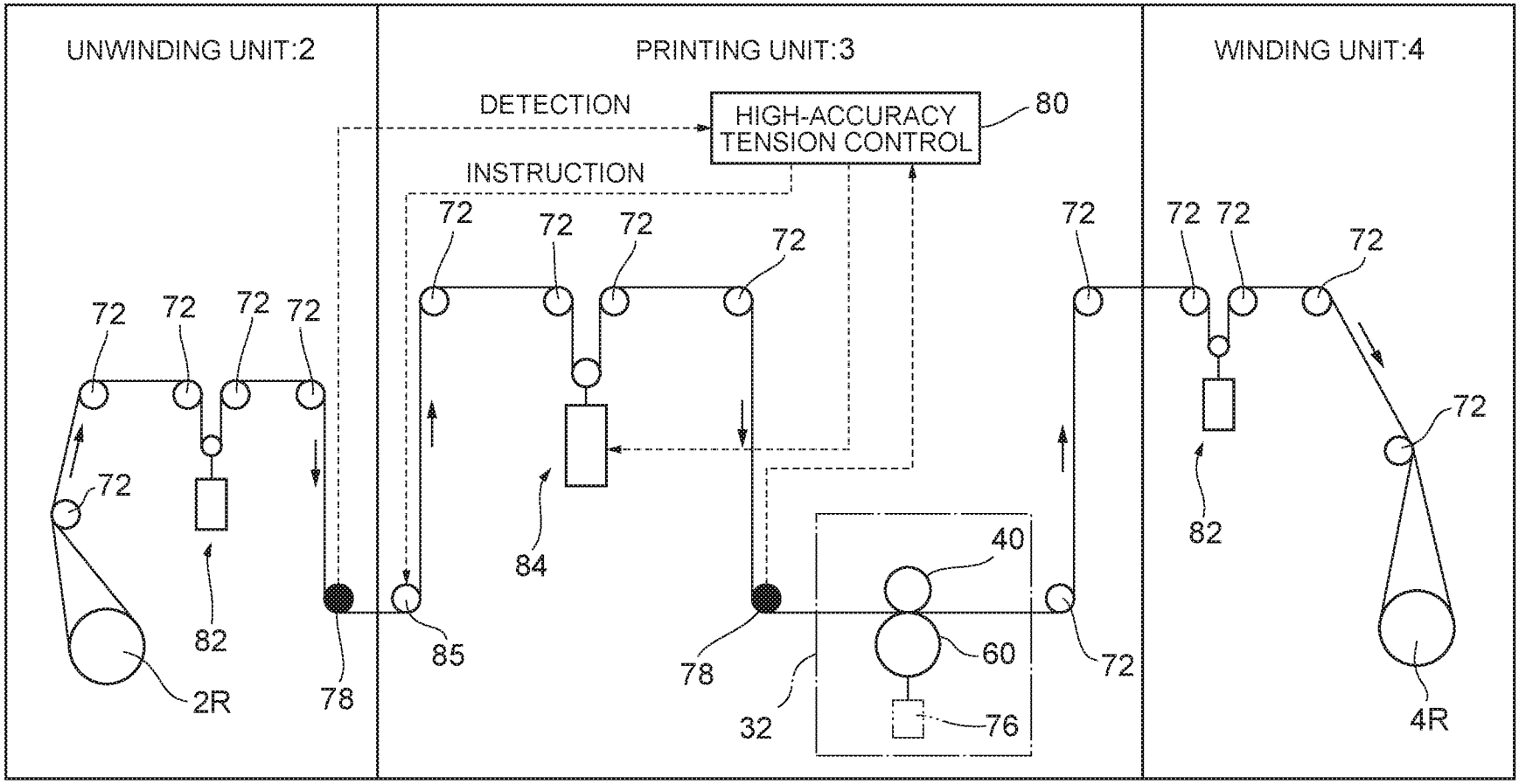
FIG. 1 is a view showing each of the devices included in a roll-to-roll printing apparatus and the brief overview of a transportation path for a base material (film).

A roll-to-roll printing apparatus 1 is a printing apparatus which includes an unwinding unit 2, a printing unit 3, a winding unit 4, and the like and seamlessly performs printing on a base material B using a roll-to-roll method (see FIG. 1). In the roll-to-roll printing apparatus 1, first, the base material B in the form of a roll is unwound using the unwinding unit 2 and transported to the printing unit 3 using drive rolls including free rolls 72, an infeed roll 85, and the like to be subjected to printing. Then, the base material B is transported to the winding unit 4 to be wound up.

The base material B is formed of, e.g., a flexible film and, in the printing unit 3, printing is performed on the surface thereof. At first, the base material B is wound around an unwinding roll 2R into the form of a roll and then unwound from the unwinding roll 2R to be fed into a printing step (see the arrow in FIG. 1) along a predetermined path. By the printing unit 3, an ink pattern is transferred and printed onto the base material B. After subjected to the printing step, the base material B is subjected to a drying step, a tension detection step, and the like (not particularly shown) to be wound by a winding roll 4R of the winding unit 4 into the form of a roll.

Printing in the printing unit 3 is performed in a printing portion 32 using a plate cylinder 40, an impression cylinder 60, and the like. The impression cylinder 60 is driven by an impression cylinder actuator 76 (see FIG. 1).

The roll-to-roll printing apparatus 1 in the present embodiment also includes, in addition to the configuration described above, the free rolls 72, tension sensors 78, a tension control device 80, a dancer 82, a dancer actuator 84, and the like. Thus, the base material B is unwound and wound, while the tension of the base material B is controlled to inhibit a tension variation.

The free rolls 72 are disposed in the path for the base material B extending from the unwinding unit 2 to the winding unit 4 through the printing unit 3 to rotate as the base material B is transported.

The tension sensors 78 detect the tension of the base material B at predetermined positions (see FIG. 1). By way of example, the tension sensors 78 in the roll-to-roll printing apparatus 1 in the present embodiment are disposed in the final stage in the unwinding unit 2 and in the stage previous to the printing portion 32 of the printing unit 3 to detect the tension of the base material B at each of the positions mentioned above and transmit detection data to the tension control device 80.

The tension control device 80 is a device formed of, e.g., a programmable drive system. The tension control device 80 receives a detection signal from each of the tension sensors 78 and controls the infeed roll 85 and the dancer actuator 84 on the basis of the detection result (see FIG. 1).

The dancer 82 is a device (dancer roll) which allows a given load to be applied to the base material B. The dancer 82 in the present embodiment allows a predetermined load in accordance with a suspended weight to be applied to the base material B via the rolls (see FIG. 1). Note that the dancer 82 used in the roll-to-roll printing apparatus 1 in the present embodiment is a known device which does not have a detector for recognizing the position of the dancer in a movable range, an actuator for driving the dancer, or the like.

The dancer actuator 84 having a significantly small mass and significantly small inertia compared to those of the dancer 82 are excellent in sensitivity and following property and operates fast to allow the tension of the base material B to be controlled with very high accuracy. In addition, the dancer actuator 84 has the function of detecting the position of the dancer to be driven thereby and the function of controlling the position of the dancer. In the present embodiment, the dancer actuator 84 is caused to function not as a mere dancer, but as an actuator for tension control. Specifically, the drive roll actuator is controlled so as to suppress a tension variation in a predetermined low frequency band, and the dancer actuator 84 is controlled so as to suppress a tension variation in a predetermined high frequency band.

<About Control Using Compensator Roll-Less Method and Control Using Compensator Roll Method in Printing Apparatus>

A typical printing control method in a gravure printing apparatus or the like aims at changing a regulated quantity by appropriately regulating an actuator and varying a quantity to be controlled as intended. A controlled object has nonlinearity. However, to actually configure a control system, consideration is given to a calculation load and to a region where the controlled object is varied, and linear approximation is performed. To perform the linear approximation, it is necessary to define a steady state. The steady state means a state where a given amount of operation is given to each of the actuators and balance is established. In each of the compensator roll-less method and the compensator roll method, to solve the problem of how to inhibit a registering error on the basis of the steady state, modeling is performed on the basis of a mechanism and an observed phenomenon, and a control input (how to move the actuator) which attains an object is determined.

A quantity which is inevitably changed by moving the actuator corresponds to "Variable". By moving the actuator, the "Variable" is changed, with the result that "Quantity to Be Controlled" is changed.

TABLE 1

| Method | Quantity to Be Controlled | Regulated Quantity | Variable |
|---|---|---|---|
| Non-compensator | Registering Error | Rotation Speed of Gravure Cylinder | Tension |
| Compensator Roll | Registering Error | Moving Speed of Compensator Roll | Tension or Pass(Path) Line Length of Base Material between Drive Rolls |

<Tension Control Model Using Dancer Actuator>

A description will be given of a tension control model using the dancer actuator 84.

(1) A tension variation in each of the units 2 to 4 is determined by changes in the speeds of the drive rolls (the impression cylinder roll 60 and the plate cylinder roll 40) previous and subsequent to the unit, changes in the speeds the free rolls 72, the influence of a tension variation in a stage previous thereto, and how the position of the dancer located in the unit changes.

(1)-2 Since a tension variation in each of a plurality of layers (each of sections) overlay-printed on the base material B depends on changes in the speeds of the drive rolls (the impression cylinder roll 60 and the plate cylinder roll 40) previous and subsequent thereto and changes in the speeds of the free rolls 72, an operation performed for the purpose of controlling the tension in the previous stage inevitably exerts influence on a stage subsequent thereto. Accordingly, to offset the influence in the subsequent stage, feedforward control between the units is required.

(2) In the printing unit 3, an amount of operation corresponds to changes in the speeds of the drive rolls such as the infeed roll 85 and a load instruction to the dancer actuator 84. For the dancer actuator 84, keeping a load constant and changing the load to keep the position are closely associated with each other and therefore it is also possible to give a position instruction instead.

(3) In a tension variation model for each of the units, the speed (time constant) of the influence of operation of the drive roll such as the infeed roll 85 or the dancer actuator 84 varies depending on a line speed (represented by "r*ω*" (the product of a radius r* and an angular speed ω*) in the unit model shown below). In addition, the magnitude (gain) of the influence of the operation varies depending on the Young's modulus of the base material B and the set tension thereof.

<Tension Control Model>

Mathematical Expressions (Maths. 1 to 11) representing models when the tension of the base material B is controlled in the roll-to-roll printing apparatus 1 are shown. Mathematical Expressions 1 to 4 represent a general format model, Mathematical Expressions 5 and 6 represent a model for the unwinding unit 2, Mathematical Expressions 7 and 8 represent a model for the printing unit 3, and Mathematical Expressions 9 to 11 represent a model for the winding unit 4. These models are obtained by modeling an input/output relationship on the basis of physical expressions.

$$L_{i0}\frac{d\Delta T_i(t)}{dt} = r_i^*\omega_i^*(-\Delta T_i(t) + \Delta T_{i-1}(t)) + 2(AE - T_i^*)y_i(t) + (AE - T_i^*)(r_{i+1}^*\Delta\omega_{i+1}(t) - r_i^*\Delta\omega_i(t)) \quad \text{[Math. 1]}$$

$$\dot{y}_i(t) = -\frac{D_i}{M_i}y_i(t) + \frac{2}{M_i}\Delta T_i(t) \quad \text{[Math. 2]}$$

$$\frac{de_{j,i}(t)}{dt} = \frac{r_i^*\omega_i^*}{AE}(-\Delta T_{j,i}(t) + \Delta T_{j-1,i}(t-L)) \quad \text{[Math. 3]}$$

$$\epsilon_i(t) = \epsilon_p^*\frac{L_{i0}}{AE\Delta L_i}\Delta T_i(t) + \Delta\epsilon_p(t) \quad \text{[Math. 4]}$$

$$L_{10}\frac{d\Delta T_1(t)}{dt} = r_1^*\omega_1^*(-\Delta T_1(t) + \Delta T_0(t)) + (AE - T_1^*)(2y_1(t) + (r_2^*\Delta\omega_2(t) - r_1^*\Delta\omega_1(t))) \quad \text{[Math. 5]}$$

$$\dot{y}_1(t) = -\frac{D_1}{M_1}y_1(t) + \frac{2}{M_1}\Delta T_1(t) \quad \text{[Math. 6]}$$

$$z_1(t) = y_1(t)$$

$$L_{20}\frac{d\Delta T_2(t)}{dt} = r_2^*\omega_2^*(-\Delta T_2(t) + \Delta T_1(t)) + (AE - T_2^*)(2y_2(t) + (r_3^*\Delta\omega_3(t) - r_2^*\Delta\omega_2(t))) \quad \text{[Math. 7]}$$

$$\dot{y}_2(t) = -\frac{D_2}{M_2}y_2(t) + \frac{2}{M_2}(\Delta T_2(t) + f_2(t)) \quad \text{[Math. 8]}$$

$$z_2(t) = y_2(t)$$

$$L_{30}\frac{d\Delta T_3(t)}{dt} = r_3^*\omega_3^*(-\Delta T_3(t) + \Delta T_2(t)) + (AE - T_3^*)(2y_3(t) + (r_4^*\Delta\omega_4(t) - r_3^*\Delta\omega_3(t))) \quad \text{[Math. 9]}$$

$$\dot{y}_3(t) = -\frac{D_3}{M_3}y_3(t) + \frac{2}{M_3}\Delta T_3(t) \quad \text{[Math. 10]}$$

$$z_3(t) = y_3(t) \quad \text{[Math. 11]}$$

Note that what is represented by each of the characters in Mathematical Expressions 1 to 11 is as shown below in Table 2.

TABLE 2

| | |
|---|---|
| $r_i$ | Radius of i-th roll |
| $\omega_i$ | Angular speed of i-th roll |
| $y_i$ | Moving speed of i-th dancer |
| $x_i$ | Position of i-th dancer |
| $T_i$ | Tension in i-th interval |
| $\Delta\omega_i$ | Control input to equilibrium state of i-th roll |
| $\Delta T_i$ | Tension variation from equilibrium state in i-th interval |
| $L_{i0}$ | Length of base material under no tension in i-th interval |
| $\Delta L_i$ | Change from length of base material under reference tension in i-th interval |
| $D_i$, $M_i$ | Factors representing dynamic characteristics of i-th dancer |
| $e_i$ | Alignment error (registering error) in i-th unit |
| $\varepsilon_i$ | Relative distortion in i-th unit |
| $\varepsilon_p$* | Distortion factor |
| $\Delta\varepsilon_p$ | Variation is assumed based on additive distortion, NIP pressure in revere printing portion, etc. |
| $f_i$ | Load instruction when i-th dancer is actuator dancer |
| A | Cross-sectional area of base material |
| E | Young's modulus |
| L | Dead time determined from length of base material and transportation speed at portion (printed portion) where alignment occurs (Alignment error is affected by tension variation. Since alignment error is relative displacement from previous-stage printing position, dead time is timing gap until influence of previous stage is observed.) |
| r(t) | Target reference input |
| d(t) | Disturbance signal |

Subsequently, using three specific examples, a description will be given of the content of a method of enhancing the accuracy of tension control in the roll-to-roll printing apparatus 1 in the present embodiment including the dancer actuator 84.

<First Accuracy Enhancing Method>

Figure 2:
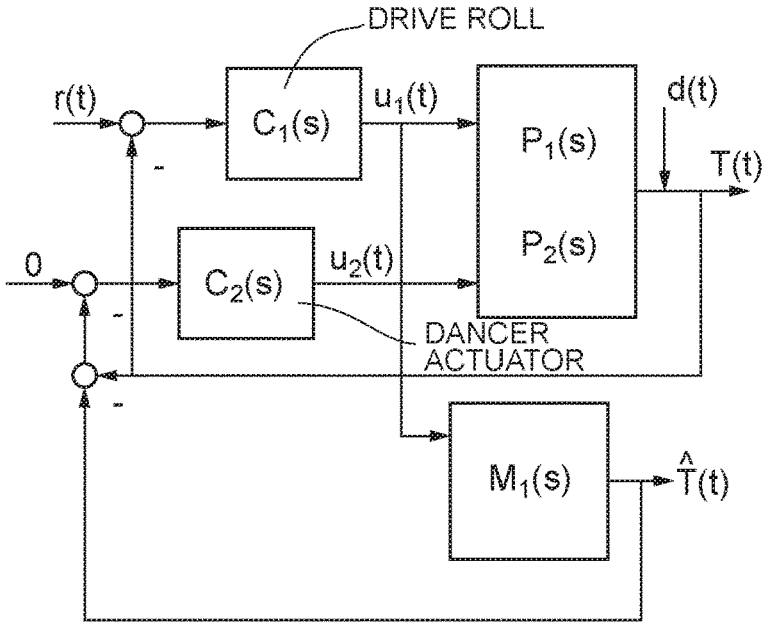
FIG. 2 is a view showing a control model in a first accuracy enhancing method for tension control in the roll-to-roll printing apparatus.

The basic strategy of the control model shown in FIG. 2 is to separate control specifications for the drive roll from control specifications for the dancer actuator 84.

Note that the following is what is represented by each of the signs in FIG. 2.

P1(*s*) . . . Transfer function representing behavior of drive roll to tension (real controlled object)

P2(*s*) . . . Transfer function representing behavior of dancer actuator to tension (real controlled object)

C1(*s*) . . . Controller which calculates amount of operation on drive roll

C2(*s*) . . . Controller which calculates amount of operation on dancer actuator M1(*s*) . . . Model of P1(*s*) portion This control model is suitable for studying a configuration for finely adjusting the variation of C2(*s*) to the vicinity of the result of control using C1(*s*). The control model may allow C2(*s*) to compensate for a modeling error in a C1(*s*) system.

Note that a closed loop transfer function in this control model is shown in Mathematical Expressions 12 and 13.

$$y(t) = \frac{P_1C_1 + P_2C_2M_1C_1}{I + P_1C_1 + P_2C_2(I + M_1C_1)}r(t) + \frac{1}{I + P_1C_1 + P_2C_2(I + M_1C_1)}d(t) \quad \text{[Math. 12]}$$

$$y(t) \rightarrow \frac{P_1C_1}{I + P_1C_1}r(t) + \frac{1}{(I + P_1C_1)(I + P_2C_2)}d(t) \quad \text{[Math. 13]}$$

When it is assumed that there is no modeling error, ($M_1(s)=P_1(s)$)

As described above with respect to the linear approximation model, a tension variation in each of the units is affected by the drive rolls previous and subsequent to the unit with the unit being interposed therebetween. In the first accuracy enhancing method, the printing unit 3 basically operates the previous-stage drive roll, while the unwinding unit 2 and the winding unit 4 basically operate the unwinding roll 2R and the winding roll 4R, to perform tension control. In other words, it is assumed that the drive roll used for control in one unit is one to inhibit interference between controls.

In the printing unit 3, an amount of operation on each of the drive rolls and an amount of operation on the dancer actuator 84 are present as two amounts of operation. Using the drive rolls each having large inertia, the general tension feedback control system of the printing unit 3 is formed to compensate for basic stability. Ideally, the tension feedback control system is designed on the basis of M1 as a model of P1. Ideally, P1 coincides with M1 but, in reality, there is a difference (referred to as a "modeling error") therebetween. To compensate for the modeling error, the dancer actuator (see the sign u2 in FIG. 2) is used to compensate for a control performance difference resulting from the modeling error and also reduce the influence of disturbance on a tension variation.

<Second Accuracy Enhancing Method>

Figure 3:
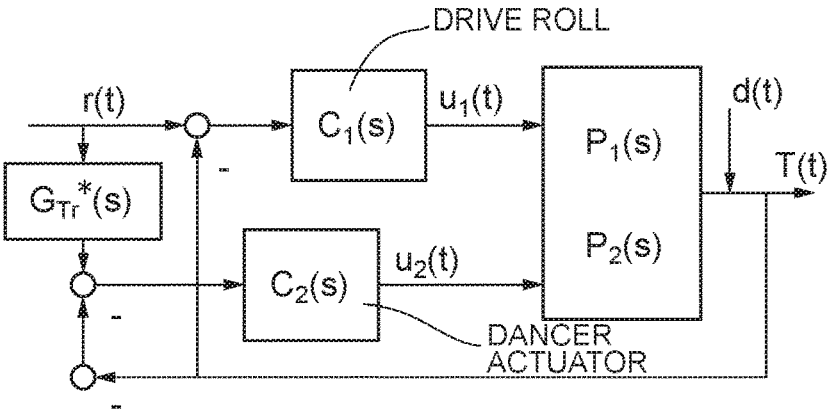
FIG. 3 is a view showing a control model in a second accuracy enhancing method for tension control in the roll-to-roll printing apparatus.

The basic strategy of the control model shown in FIG. 3 is to separate control specifications for the drive roll from control specifications for the dancer actuator 84.

Note that the following is what is represented by each of the signs in FIG. 3.

P1(*s*) . . . Transfer function representing behavior of drive roll to tension (real controlled object)

P2(*s*) . . . Transfer function representing behavior of dancer actuator to tension (real controlled object)

C1(*s*) . . . Controller which calculates amount of operation on drive roll

C2(*s*) . . . Controller which calculates amount of operation on dancer actuator GTr*(s) . . . Ideal response from a closed loop system formed of C1(*s*)

This control model is suitable for finely adjusting the variation of C2(*s*) to the vicinity of the result of control using C1(*s*). The control model can allow C2(*s*) to compensate for the portion of the C1(*s*) system that has deviated from an intended way of movement thereof.

Note that a closed loop transfer function in this control model is shown in Mathematical Expressions 14 to 16.

$$G_{Tr}^{*}(s) = \frac{P_1 C_1^{*}}{I + P_1 C_1^{*}} \quad \text{[Math. 14]}$$

$$y(t) = \frac{P_1 C_1 (I + P_1 C_1^{*}) + P_2 C_2 P_1 C_1^{*}}{(I + P_1 C_1 + P_2 C_2)(I + P_1 C_1^{*})} r(t) + \frac{1}{I + P_1 C_1 + P_2 C_2} d(t) \quad \text{[Math. 15]}$$

$$y(t) \rightarrow \frac{P_1 C_1^{*}}{I + P_1 C_1^{*}} r(t) + \frac{1}{I + P_1 C_1^{*} + P_2 C_2} d(t) \quad \text{[Math. 16]}$$

When it is assumed that a C1 system gives an ideal response, ($C_1(s)=C_1^{*}(s)$)

As described above with respect to the linear approximation model, a tension variation in each of the units is affected by the drive rolls previous and subsequent to the unit with the unit being interposed therebetween. In the second accuracy enhancing method, the printing unit 3 basically operates the previous-stage drive roll, while the unwinding unit 2 and the winding unit 4 basically operate the unwinding roll 2R and the winding roll 4R, to perform tension control. In other words, it is assumed that the drive roll used for control in one unit is one to inhibit interference between controls.

In the printing unit 3, an amount of operation on each of the drive rolls and an amount of operation on the dancer actuator 84 are present as two amounts of operation. Using the drive rolls each having large inertia, the general tension feedback control system of the printing unit 3 is formed to compensate for basic stability. Ideally, the tension feedback control system is designed on the basis of M1 as a model of P1. Ideally, P1 coincides with M1 but, in reality, there is a difference (referred to as the "modeling error") therebetween. Due to the modeling error, real movement deviates from an ideal response GTr defining an originally intended way of movement. To compensate for the deviation, the dancer actuator (see the sign u2 in FIG. 3) is used to compensate for the deviation from the ideal response due to the modeling error and also reduce the influence of disturbance.

<Third Accuracy Enhancing Method>

Figure 4:
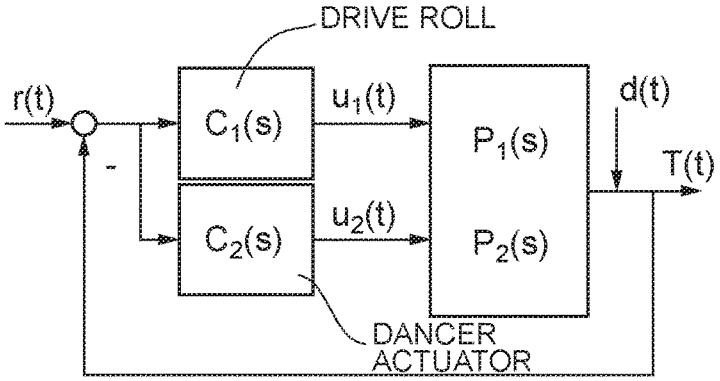
FIG. 4 is a view showing a control model in a third accuracy enhancing method for tension control in the roll-to-roll printing apparatus.

The basic strategy of the control model shown in FIG. 4 is to separate control specifications for the drive roll from control specifications for the dancer actuator 84.

Note that the following is what is represented by each of the signs in FIG. 4.

P1(*s*) . . . Transfer function representing behavior of drive roll to tension (real controlled object)

P2(*s*) . . . Transfer function representing behavior of dancer actuator to tension (real controlled object)

C1(*s*) . . . Controller which calculates amount of operation on drive roll

C2(*s*) . . . Controller which calculates amount of operation on dancer actuator GTr*(s) . . . Ideal response from a closed loop system formed of C1(*s*)

In this control model, C1(*s*) and C2(*s*) are incorporated into control system and, are designed as controllers in which the result of control by C1(*s*) and the result of control by C2(*s*) take into consideration of the performance difference between both actuators. The control system is designed such that the C1(*s*) system can perform gentle control and the C2(*s*) system can perform quick control. This control mode allows an intended way of movement to be achieved by establishing a balance between C1(*s*) and C2(*s*).

Note that a closed loop transfer function in this control model is shown in Mathematical Expression 17.

$$y(t) = \frac{P_1 C_1 + P_2 C_2}{(I + P_1 C_1 + P_2 C_2)} r(t) + \frac{1}{I + P_1 C_1 + P_2 C_2} d(t) \quad \text{[Math. 17]}$$

As described above with respect to the linear approximation model, a tension variation in each of the units is affected by the drive rolls previous and subsequent to the unit with the unit being interposed therebetween. In the first accuracy enhancing method, the printing unit 3 basically operates the previous-stage drive roll, while the unwinding unit 2 and the winding unit 4 basically operate the unwinding roll 2R and the winding roll 4R, to perform tension control. In other words, it is assumed that the drive roll used for control in one unit is one to inhibit interference between controls.

In the printing unit 3, an amount of operation on each of the drive rolls and an amount of operation on the dancer actuator 84 are present as two amounts of operation. Using the drive rolls each having large inertia, the general tension feedback control system of the printing unit 3 is formed to compensate for basic stability. Under this control, in consideration of the characteristic difference between P1 and P2, the entire control system is designed to have a response characteristic such that the C1 system compensates for basic stability and the C2 system inhibits disturbance.

The roll-to-roll printing apparatus 1 in the present embodiment is configured such that the dancer actuator 84 capable of performing very-high-accuracy tension control is disposed between the drive rolls and the dancer actuator 84 itself is caused to function as a tension control actuator (i.e., as a so-called new dancer unit). This allows the drive rolls and the dancer actuator 84 to share the function of compensating for a tension variation on the basis of the operation performance difference therebetween. In such a case, control sharing is achieved by assigning general or relatively rough control (provision of a steady state) to the drive rolls and the drive actuator and assigning refined or relatively fine control to the very-high-accuracy dancer actuator 84. Thus, a wide operative range and refined tension control performance which are difficult to provide when only either one of the methods is used are provided.

While the embodiment described above is an example of the preferred embodiment of the present invention, the present invention is not limited thereto. The present invention can variously be modified and implemented within a scope not departing from the gist of the present invention.

INDUSTRIAL APPLICABILITY

The present invention is applied appropriately to a roll-to-roll printing apparatus which seamlessly performs printing on a base material using a roll-to-roll method.

REFERENCE SIGNS LIST

1 Roll-to-roll printing apparatus
2 Unwinding unit
2R Unwinding roll
3 Printing unit
4 Winding unit
4R Winding roll
20 Ink supply member
30 Blanket cylinder
40 Plate cylinder
60 Impression cylinder
72 Free roll
76 Impression cylinder actuator
78 Tension sensor (tension detection device)
80 Tension control device
82 Dancer
84 Dancer actuator
85 Infeed roll
B Base material

What is claimed is:

1. A roll-to-roll printing apparatus comprising:

an unwinding unit that unwinds a base material, a printing unit that performs printing on the base material unwound from the unwinding unit, a winding unit that winds up the base material subjected to the printing by a printing portion provided in the printing unit, a drive roll that is disposed in a stage previous to the printing portion and supplies the base material to the printing portion;

a drive roll actuator that rotates the drive roll;

a plate cylinder that is disposed in the printing portion and performs printing on the base material, a dancer actuator disposed between the plate cylinder and another drive roll to vary a tension of the base material by changing a path line length of the base material;

a tension detection device that is disposed in a stage previous to the printing portion and detects the tension of the base material; and a tension control device that controls the drive roll actuator and the dancer actuator in accordance with a result of the detection by the tension detection device to compensate for a variation in the tension of the base material in a stage previous to the printing portion, wherein, when compensating for the variation in the tension of the base material, the tension control device controls the drive roll actuator so that a tension variation in a predetermined low frequency band is inhibited, and controls the dancer actuator so that a tension variation in a predetermined high frequency band is inhibited, the roll-to-roll printing apparatus seamlessly performs printing on the base material using a roll-to-roll method.

2. The roll-to-roll printing apparatus according to claim 1, wherein the dancer actuator is disposed between the drive roll and the plate cylinder.

3. The roll-to-roll printing apparatus according to claim 2, wherein the tension control device uses the dancer actuator to perform feedback control on the drive roll actuator for the drive roll disposed in a stage previous to the dancer actuator and perform feed-forward control on the drive roll actuator for the drive roll disposed in a stage subsequent to the dancer actuator.

4. The roll-to-roll printing apparatus according to claim 1, wherein the drive roll has a large inertia compared to the dancer actuator.

5. The roll-to-roll printing apparatus according to claim 1, further comprising a dancer that is disposed in a stage previous to the drive roll and allows a predetermined load to be applied to the dancer via a roll, wherein the dancer actuator has a small inertia compared to the dancer when changing the path line length of the base material.

* * * * *